United States Patent [19]

Ierna

[11] Patent Number: 4,704,557

[45] Date of Patent: Nov. 3, 1987

[54] CERMET INSERT HIGH VOLTAGE HOLDOFF FOR CERAMIC/METAL VACUUM DEVICES

[75] Inventor: William F. Ierna, Seminole, Fla.

[73] Assignee: The United States of America as represented by the United States Department of Energy, Washington, D.C.

[21] Appl. No.: 838,493

[22] Filed: Mar. 11, 1986

[51] Int. Cl.[4] ..... H01J 5/26; H01J 5/36; H01J 61/36

[52] U.S. Cl. ..... 313/623; 313/636; 313/289; 174/50.61

[58] Field of Search ..... 313/623, 289, 636; 65/59.1; 501/94; 174/50.61, 50.62, 50.63, 50.64

[56] References Cited

U.S. PATENT DOCUMENTS

| | | | |
|---|---|---|---|
| 2,174,375 | 9/1939 | Beggs | 250/27.5 |
| 2,431,277 | 11/1947 | Pressel | 250/27.5 |
| 2,446,277 | 8/1948 | Gordon | 250/27.5 |
| 2,450,780 | 10/1948 | Bucklen | 200/152 |
| 2,836,935 | 6/1958 | Stanworth et al. | 49/81 |
| 2,949,376 | 8/1960 | Comer | 106/53 |
| 3,062,981 | 11/1962 | Stoeckert et al. | 313/289 |
| 3,304,362 | 2/1967 | August | 174/50.56 |
| 3,355,564 | 11/1967 | Ranheim | 200/144 |
| 3,371,406 | 3/1968 | Bronnes et al. | 29/473.1 |
| 3,840,408 | 10/1974 | Bondley | 136/133 |
| 3,854,827 | 12/1974 | Merz et al. | 403/29 |
| 4,001,625 | 1/1977 | Schat et al. | 313/623 |
| 4,092,560 | 5/1978 | Puskas | 313/623 X |
| 4,334,628 | 6/1982 | Buhrer et al. | 220/2.1 R |
| 4,366,410 | 12/1982 | Buhrer | 313/221 |

*Primary Examiner*—David K. Moore
*Assistant Examiner*—K. Wieder
*Attorney, Agent, or Firm*—George H. Libman; Judson R. Hightower

[57] ABSTRACT

An improved metal-to-ceramic seal is provided wherein the ceramic body of the seal contains an integral region of cermet material in electrical contact with the metallic member, e.g., an electrode, of the seal. The seal is useful in high voltage vacuum devices, e.g., vacuum switches, and increases the high-voltage holdoff capabilities of such devices. A method of fabricating such seals is also provided.

11 Claims, 1 Drawing Figure

CERMET INSERT HIGH VOLTAGE HOLDOFF FOR CERAMIC/METAL VACUUM DEVICES

The U.S. Government has rights in this invention pursuant to contract No. DE-ACO4-76DP00656 between the U.S. Department of Energy and General Electric Co.

BACKGROUND OF THE INVENTION

This invention relates to metal-to-ceramic seals, high voltage vacuum devices employing such seals and processes for fabricating them.

High voltage vacuum devices, e.g., vacuum tubes, vacuum switches, and the like, have been known for many years. Such devices contain electrodes surrounded by an envelope which isolates the electrodes from atmospheric conditions. The electrodes are supported by insulators and, frequently, the envelope of such a device serves an insulating function as well. The insulators and the envelope have frequently been fabricated from glass or glass-like materials. However, in some instances, it is desirable to fabricate the insulators and/or envelope from ceramic materials.

Such components, when manufactured from ceramic materials, have exhibited poor high voltage holdoff. As used herein, high voltage holdoff refers to the ability of a high voltage vacuum device containing two or more electrodes to have a high voltage electrical potential established between the electrodes without, e.g., arcing therebetween or along the interior walls of the device. Once such arcing occurs, a conductive path is frequently established along the interior wall of the device. In general, once such arcing occurs, the device will not subsequently function properly. This is a particular problem in small devices, where the distance between electrodes is small.

In contradistinction, high voltage vacuum devices wherein such components are fabricated of glass, or glass-like materials, generally exhibit good high voltage holdoff. This is due to the nature of the electric field gradient at the metal/glass joint or seal. As used herein, electric field gradient refers to the transition in electrical resistivity exhibited at the metal/glass or metal/-ceramic joint or seal.

In metal-to-ceramic seals or joints, the transition in resistivity is abrupt. Thus, at the seal or joint, highly conductive metal is in contact with highly non-conductive ceramic. The electric field gradient is therefore not gradual. Prior art high voltage vacuum devices wherein an electrode member is embedded in the ceramic walls of the device have been attempted but have exhibited poor mechanical stability resulting from thermal stress due to the differences in coefficients of expansion of ceramic and metal.

Various prior art devices employ metal-to-ceramic seals which include, in addition to the metal and ceramic, an additional material. U.S. Pat. No. 3,355,564 discloses a vacuum circuit interrupter which includes a metal-to-ceramic joint which also includes a metallization layer of an alloy of molybdenum and manganese. It is applied to enhance the mechanical strength of the joint and effects negligible electrical gradient. U.S. Pat. No. 4,366,410 provides similar disclosure.

U.S. Pat. No. 3,854,827 discloses a metal-to-ceramic leadthrough which includes, in addition to the molybdenum conductor in the ceramic body, a glass-like material comprising MnO, $SiO_2$ and $Al_2O_3$. U.S. Pat. No. 4,334,628 presents a similar disclosure.

U.S. Pat. Nos. 2,174,375; 2,431,277; 2,450,780; 2,446,277, 2,836,935; 2,949,376; 3,062,981; 3,304,362; 3,371,406 and 3,343,515 further represent the state-of-the-art.

In general, prior art high voltage vacuum devices having ceramic-to-metal seals exhibit inadequate performance due to low high-voltage holdoff capabilities and poor mechanical stability.

SUMMARY OF THE INVENTION

Accordingly, it is an object of this invention to provide a metal-to-ceramic seal which exhibits improved high voltage holdoff and mechanical stability.

Another object of this invention is to provide a device, e.g., a high voltage vacuum device, having a metal-to-ceramic seal, which device exhibits improved high voltage holdoff and mechanical stability.

Yet another object of this invention is to provide a method of fabricating such a metal-to-ceramic seal for use in such high voltage vacuum devices.

Upon further study of the specification and appended claims, further objects and advantages of this invention will become apparent to those skilled in the art.

In accordance with one aspect of this invention, these objects have been obtained by providing in a metal-to-ceramic seal comprising a metallic conductor and a body of ceramic material the improvement wherein said seal comprises a region of cermet material substantially integral with said ceramic body and in electrical contact with said conductor, said cermet material having a resistivity greater than said conductor and a resistivity less than said ceramic material.

In accordance with another aspect of this invention, these objects have been attained by providing in a high voltage vacuum device comprising a ceramic body having walls which define a cavity, means for sealing said cavity from the atmosphere, and an electrode member within said cavity, said electrode member having a portion thereof sealed to said wall of said body, the improvement wherein said ceramic body further comprises a region of cermet material in electrical contact with said electrode, said cermet material having a resistivity higher than said electrode and less than said ceramic material.

In accordance with another aspect of this invention, these objects have been attained by providing a method of fabricating a metal-to-ceramic seal comprising a metallic conductor and a ceramic insulator comprising applying a slurry of cermet material to said ceramic body, subjecting the resultant composite to isostatic pressure sufficient to remove voids in the resulting cermet material, sintering the resultant composite to produce a composite containing a region of cermet material substantially integral with said cermic body, and sealing said conductor to said composite such that said conductor is in electrical contact with said region of cermet material.

BRIEF DESCRIPTION OF THE DRAWINGS

Various other objects, features and attendant advantages of the present invention will become more fully appreciated as the same becomes better understood when considered in conjunction with the accompanying drawing, wherein.

DETAILED DISCUSSION

Figure 1:
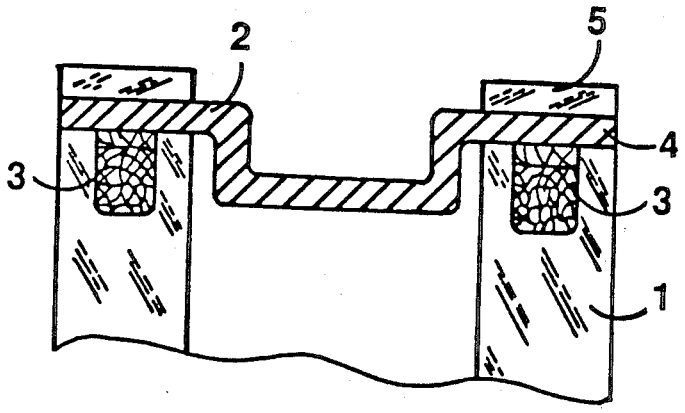
FIG. 1 is a schematic representation of one embodiment of a metal-to-ceramic seal of this invention.

This invention is based on the finding that providing a ceramic body with a region of cermet material which is essentially integral with the ceramic body and in electrical contact with the metallic component, e.g., an electrode, of a metal-to-ceramic seal significantly improves the high voltage holdoff capabilities of a high voltage vacuum device in which the seal is employed. Although substantially integral with the ceramic body, the region of cermet material is also referred to herein as a cermet insert.

It is believed that such a metal-to-ceramic seal provides improved high voltage holdoff because it provides a gradual transition in resistivity, i.e., electric field grading, from the highly conductive electrode to the essentially non-conductive ceramic body through the intermediate resistivity of the cermet material. In contradistinction, a metal-to-ceramic seal without a cermet insert exhibits an abrupt transition in resistivity at the metal-to-ceramic interface. This discontinuity results in an area of high field stress when the metal component is subjected to a high electrical potential. When such high field stress occurs, the resultant, low high-voltage holdoff results in failure.

Preferably, the cermet material is embedded within or integral with the ceramic material and the metal element is in electrical contact with the cermet material. In a typical high voltage vacuum device of this invention, the ceramic body is generally cylindrical and functions as the main envelope, isolating the electrically functional portions of the electrode from the atmosphere. The dimensions of the region of cermet material are not critical so long as enough cermet material is present to result in high voltage holdoff. Depths of 0.070–0.100 inch are suitable. In many applications, e.g., vacuum switches, the cermet body is advantageously annular or ring-shaped and the electrode also functions as an end cap, i.e., the electrode is disc-shaped and the edges are sealed to the ceramic body. Such an embodiment is structurally similar to the metal-to-glass seals of vacuum tube envelopes. However, the invention is applicable to any metal-to-ceramic seal, especially those intended to be used in an environment where high voltage holdoff between the metal element of the seal, e.g., an electrode, and another metal element is desired, usually the other electrode. The use of the devices of this invention is fully conventional.

It is not necessary that the electrode or metallic member be embedded in the cermet material. Accordingly, in typical applications, it is sufficient that the metal member or electrode be in electrical contact with the region of cermet material. Thus, in a typical application, e.g., a pulsed vacuum switch, where the ceramic body comprises a generally cylindrical envelope and the electrode is disc-shaped and functions to hermetically seal one end of the envelope from the atmosphere, the region of cermet material is generally annular, within the body of the ceramic cylinder. The cermet material is also flush with and extends to the edge or end of the ceramic cylinder. When the outer rim of the electrode is then placed over the end of the cylinder and sealed thereto, the electrode is thereby in electrical contact with the cermet material. The resultant metal-to-ceramic seal provides a relatively gradual transition in resistivity in comparison with a metal-to-ceramic seal of the prior art which does not employ the region of cermet material of this invention. Accordingly, use of the cermet material, e.g., as an insert as described above, results in grading of the electric field in use which significantly enhances high voltage holdoff.

FIG. 1 schematically illustrates an embodiment of this invention as described above. In this embodiment, the metal-to-ceramic seal comprises a ceramic body 1, a metallic electrode member 2 and a region of cermet material or cermet insert 3. The ceramic member is generally tubular and the electrode is generally disc-shaped. The outer rim or periphery of the electrode is sealed to the end face 4 of the ceramic body by conventional glass-to-metal or glass-to-ceramic techniques, e.g., by brazing. The electrode is therefore in electrical contact with both the ceramic body 1 and the annular ring of cermet material 3. Advantageously, an end ring 5 of, e.g., ceramic material can be brazed to the rim of the electrode at the face of the electrode which is not bonded to the ceramic body and cermet material. The ceramic body has another electrode (not shown) at the end of the tube other than that at which electrode 2 is sealed. In operation, when high-voltage electrical potential is established between the two electrodes, the metal-to-ceramic seal of this invention exhibits a gradual field gradient at the metal-to-ceramic seal and extending away from the electrode 2. Although the cermet material is shown as a discrete region, it is integral with the ceramic body and the boundary between the region of cermet material and ceramic material of the body is not abrupt.

Other configurations are possible as well. Thus, the region of cermet material need not be annular. It could be cylindrical, e.g., occupying a cylindrical bore in the body of ceramic material.

In general, the cermet material is a mixture of metallic materials and ceramic materials. The ceramic of the cermet material is preferably the same ceramic as the ceramic body. The cermet material has a coefficient of expansion similar to that of the ceramic material. This results in a structure which is stable, e.g., will not crack, etc, under normal stress. In general, any metallic material and ceramic material can be employed in the cermet as long as the coefficient of expansion of the cermet is matched to the coefficient of expansion of the ceramic body such that the resultant structure does not crack under thermal stress. Thus, when the ceramic body comprises a high alumina material, e.g., primarily aluminum oxide, the cermet material is preferably a mixture of aluminum oxide and molybdenum. Molybdenum has a coefficient of expansion which is closer to the coefficient of expansion of high alumina ceramic material than other metals, many of which are high expansion metals. Preferably, the mixture is 50% molybdenum and 50% aluminum oxide. However, mixtures of 55% molybdenum and 45% aluminum oxide, and 45% molybdenum and 55% aluminum oxide have been found acceptable. In other applications, e.g., when mixtures of ceramics other than aluminum oxide and metals other than molybdenum are employed, different proportions may be employed with routine orientation experiments to optimize the components and the proportions. Optimization of coefficients of expansion is fully conventional in, e.g., the art pertaining to metal-to-glass seals and coefficients of expansion for such materials as well as information regarding optimally matching such materials is fully available in the technical literature.

In general, the cermet material has a resistivity which is about 20 orders of magnitude less than the resistivity of the ceramic material. Thus, if the high alumina ceramic material from which the ceramic body is fabricated has a resistivity of about $10^{+17}$ ohm-cm, the cermet material of this invention has a resistivity of about $10^{-4}$ ohm-cm.

In general, the ceramic body comprises a high alumina material, e.g., 95–97% aluminum oxide, the remainder being binders, e.g., clays, etc., as is fully conventional in ceramic materials.

The composition of the metallic member is fully conventional. Any metallic electrode or conductor can be employed, e.g., an electrode comprising iron, nickel and cobalt alloy.

The metal-to-ceramic seals of this invention have particular applications in high voltage vacuum devices wherein high voltage electrical potential exists between two or more electrodes.

In general, use of the metal-to-ceramic seals of this invention provides an increase in high voltage holdoff of about 20% when compared with the prior art. Thus, if a prior art high voltage vacuum device employing conventional metal-to-ceramic seals can have 100,000 volts potential between the two electrodes before arcing or breakdown occurs, a similar device employing the metal-to-ceramic seals of this invention can have an electrical potential between the two electrodes of about 120,000 volts before breakdown or arching occurs. Frequently, such devices are operated in a "pulsed mode" and must exhibit high voltage holdoff for a period of microseconds, e.g., 5–10 microseconds.

As stated above, the region of cermet material of this invention is generally integral with the ceramic body. Thus, the ceramic body contains a region of material which is essentially cermet material which has been made part of the ceramic body by, e.g., isostatic pressing and sintering. The cermet material is made by first preparing a mixture of powdered cermet material mixed by, e.g., dry mixing a 50/50 mix of powdered conductive material and powdered ceramic material, e.g., powdered molybdenum and powdered aluminum oxide. Advantageously, the mixing is carried out in a ball mill, e.g., a mill jar equipped with loose grinding rods or pebbles. The resultant cermet powder is then slurried in a suitable liquid vehicle, e.g., amyl acetate or the like. The liquid and cermet powder are blended, along with a surfactant, in a conventional mixer, e.g., a tilted mixer, to obtain a creamy uniform slurry. The amount of liquid and surfactant used is not critical, so long as the slurry is sufficiently fluid to be workable, i.e., spread into a void in the ceramic body. For example, if the cermet powder is 50% molybdenum and 50% aluminum oxide and the liquid vehicle is DGME acetate, a suitable slurry may be prepared by mixing about 20 g of cermet powder with about 7 to 12 ml of DGME acetate and about 2 drops of surfactant. The liquid vehicle used is not critical. DGME acetate and amyl acetate are exemplary. The surfactant is not critical. Preferably, the slurry is prepared fresh.

In general, the slurry is loaded into a void in the ceramic body, oven dried and subjected to isostatic pressing, followed by sintering. However, in certain applications, the slurry can be molded as an extension of the ceramic body. In applications where the ceramic body is generally tubular and intended for use as the envelope of a high voltage vacuum device, the end face of the cylinder is provided with an annular recess which can be machined into the end face of the cylinder. The dimensions of the recess are not critical, as long as the recess can receive sufficient cermet material to provide a gradual transition in resistivity as described above.

For high-voltage vacuum devices such as those of FIG. 1, where the ceramic body has an internal diameter of 0.550 inch and an external diameter of 0.750 inch, an annular recess having a depth of about 0.070–0.100 inch and a width across the annulus of the recess of 0.050 inch has been found acceptable.

The annular recess is then filled with the slurry prepared as outlined above. The ceramic body loaded with the slurry is then dried, e.g., in drying oven maintained at about 130° C., e.g., 120°–140° C.

The ceramic body containing the dried cermet material is then placed in an isostatic press and the cermet material is subjected to isostatic pressure. The degree of isostatic pressure applied is not critical, so long as voids in the cermet material are removed by the pressing step. Generally, isostatic pressure of about 30,000 psi, e.g., 28,000–32,000 psi, has been found satisfactory. The isostatic pressing step of this invention per se is carried out using fully conventional apparatus and techniques, under conditions which are routinely determinable in accordance with this disclosure in conjunction with conventional considerations. In general, the conditions for carrying out of the steps of this invention are fully conventional per se or at least fully conventionally determinable based on conventional considerations in conjuncture with this disclosure. Particular pressure values appropriate for a given application or given cermet or ceramic materials are readily routinely selected, perhaps with a few preliminary orientation experiments.

The resultant composite is then sintered, e.g., fired at elevated temperatures, e.g., 1,630° C. The sintering step of this invention is also per se conventional. The temperature and time parameters are routinely selectable. In general, it is desirable to optimize the sintering conditions so that the resultant product is one in which the cermet material is essentially integral with the ceramic material, i.e., such that a unitary composite product results.

In applications where the resultant composite comprises the envelope of a high voltage vacuum device and the resultant device comprises an electrode which is generally pan or disc-shaped, the electrode is then sealed to the end face of the cylindrical envelope to provide a metal-to-ceramic seal using fully conventional steps. For example, the end face of the cylinder can be provided with a metalized coating, e.g., a coating containing molybdenum, manganese and titanium or a coating containing only manganese. This coating is then subjected to high temperatures, e.g., 1,500° C. to react it with the ceramic. The rim portion of the metal electrode is then brazed to the resultant surface resulting in a metal-to-ceramic seal.

The metal-to-ceramic seals of this invention are not limited to the structure defined above. Thus, the region of cermet material need not be annular. For example, the body of ceramic material can be provided with a cylindrical bore or bores in the walls thereof and the cylindrical bore filled with cermet slurry as described above. It has been found advantageous to fill such a bore with slurry by the aid of vacuum, e.g., by placing a piece of filter paper over a vacuum intake, placing a bore over the intake and filling the bore with the above-described slurry. The vacuum aids in substantially filling the void of the bore which otherwise is difficult to fill by means of, e.g., manual pressure alone. The resultant composite is then subjected to drying, isostatic pressing and sintering as described above. During isostatic pressing, the composites can be placed in a sealed container, e.g., latex tubing, the ends of which are sealed. The sintered composite can then be provided with a metallic element, e.g., a conductor or electrode, attached so that the resultant region of cermet material is in electrical contact with the metallic member to provide a metal-to-ceramic seal of this invention.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the preceding text and the following examples, all temperatures are set forth uncorrected in degrees Celsius and all parts and percentages are by weight, unless otherwise indicated.

PREPARATION OF CERMET SLURRY

Example 1

500±1.5 g of molybdenum powder having an average particle size of 15–20 microns and 500±1.5 g of ceramic power (aluminum oxide) were placed in a ball mill apparatus comprising a ball mill machine, a number 1 mill jar and 7,000±50 g of grinding rods, e.g., ceramic pebbles. The mixture was tumbled in dry condition in the jar for 1 hour ±0.1 hour at 60±10 rpm, at the end of which time the contents were emptied onto a screen adapted to retain the grinding rods but allow the cermet powder to collect in a pan placed under the screen. A short bristle brush was used to remove adhering powder, taking care not to allow those bristles to contaminate the powder. The cermet powder was stored in a plastic container. 20±0.2 g of the resultant cermet powder was mixed with 7–12 ml of DGME acetate in a slurry pot with three ½", three ⅜", and three ¼" steel balls. Using an eyedropper, surfactant was added as required. The mixture was blended in a tilted type mixer for a minimum of ½ hour to obtain a creamy uniform slurry.

PREPARATION OF CERAMIC/CERMET COMPOSITE

Example 2

A ceramic body formed from the same ceramic material as that used in the preparation of the cermet slurry of Example 1 was selected. The ceramic body was generally tubular and was provided with an annular recess in the end face thereof. The recess was filled with the slurry, produced in accordance with Example 1, with a spatula. The resultant comosite was placed on a tray which was placed in a drying oven preheated and maintained at 130° C.±10° C. The composite remained in the drying oven for 17 hours +1 hour, −½ hour. The resultant composite was inspected for obvious defects, e.g., cracks and inclusions of foreign material, particularly in cavities and similar locations. Filtered compressed air and a small brush was used to remove any foreign material, using care to avoid damaging cavity surfaces. The composite was then placed in an isostatic press and subjected to isostatic pressure at 30,000 psi±2,000 psi. The resultant composite was then subjected to fully conventional sintering techniques.

EXAMPLE 3

Ceramic bodies provided with bore holes were loaded with the cermet slurry freshly prepared in accordance with Example 1 as follows:

One end of the bore hole was placed over a line connected to the intake side of a vacuum pump with a piece of filter paper between the hole and the vacuum intake line. With the vacuum on, the hole was loaded with cermet slurry using an eyedropper. Subsequent holes were loaded using fresh filter paper. Advantageously, the hole was wetted with cermet slurry liquid vehicle. The resulting composite was oven dried according to Example 2. The resultant composites were inspected for defects and inclusion of foreign material and cleaned as described in Example 2. The composites were placed in latex tubing taking care to prevent chipping of the edges of the composites, and, where more than one composite was being processed, the parts were separated from each other within the tubing by mechanical clips. Each end of the tubing was sealed with a clip. The composite parts were then placed in an isostatic press and subjected to isostatic pressure of 30,000 psi±2,000 psi. The parts were removed from the tubing and inspected for obvious defects, e.g., fluid leaks.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A high voltage holdoff metal-to-ceramic seal for a vacuum device, said seal comprising:

a metallic conductor;

a body of ceramic material in sealing contact with said metallic conductor; and a region of cermet material substantially integral with said ceramic material and in electrical contact with said conductor, said cermet material having a resistivity less than said ceramic material, whereby the resultant resistivity gradient in said seal is effective to substantially increase the voltage holdoff capacity of said seal.

2. A metal-to-ceramic seal of claim 1, wherein said cermet material and said ceramic material have about the same coefficient of expansion.

3. A metal-to-ceramic seal of claim 2, wherein said ceramic material comprises aluminum oxide and said cermet material comprises a mixture of aluminum oxide and metallic material.

4. A metal-to-ceramic seal of claim 2, wherein said ceramic material comprises aluminum oxide and said cermet material comprises a mixture of aluminum oxide and molybdenum.

5. A metal-to-ceramic seal of claim 1, wherein said cermet material has a resistivity about 20 orders of magnitude less than the resistivity of said ceramic material.

6. A metal-to-ceramic seal of claim 1, wherein said ceramic material is essentially tubular and said region of cermet material is essentially annular.

7. A metal-to-ceramic seal of claim 6 wherein said cermet material is contained within a recess in an end surface of said ceramic material in contact with said metallic conductor.

8. A metal-to-ceramic seal of claim 7 wherein the recess has a rectangular cross-section and the depth of the recess is greater than the width of the recess.

9. A ceramic-to-metal seal of claim 8 wherein the width of the recess is about $\frac{1}{4}$ the width of said ceramic surface.

10. A high voltage holdoff seal for a vacuum device, said seal comprising:

a low resistivity metallic conductor;

a body of high resistivity ceramic material having a surface in vacuum sealing contact with said metallic conductor; and means, extending from said surface into said body, for reducing the resistivity of said body near said surface to substantially increase the voltage holdoff capacity of said seal.

11. A high voltage holdoff seal of claim 10 wherein said means comprises a cermet material extending into a recess in said body.

* * * * *